US011691841B2

(12) United States Patent
Noda et al.

(10) Patent No.: US 11,691,841 B2
(45) Date of Patent: Jul. 4, 2023

(54) SHEET CONVEYER AND IMAGE FORMING APPARATUS

(71) Applicant: BROTHER KOGYO KABUSHIKI KAISHA, Nagoya (JP)

(72) Inventors: Ryuji Noda, Aichi (JP); Yusuke Ikegami, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 101 days.

(21) Appl. No.: 17/129,771

(22) Filed: Dec. 21, 2020

(65) Prior Publication Data

US 2021/0198073 A1 Jul. 1, 2021

(30) Foreign Application Priority Data

Dec. 27, 2019 (JP) ..... 2019-238561

(51) Int. Cl.
*B65H 29/60* (2006.01)
*B65H 85/00* (2006.01)

(52) U.S. Cl.
CPC ..... *B65H 29/60* (2013.01); *B65H 85/00* (2013.01); *B65H 2404/1115* (2013.01); *B65H 2404/63* (2013.01); *B65H 2404/632* (2013.01)

(58) Field of Classification Search
CPC .... B65H 29/60; B65H 29/58; B65H 2404/63; B65H 2404/31
See application file for complete search history.

(56) References Cited

U.S. PATENT DOCUMENTS

| | | | | |
|---|---|---|---|---|
| 8,496,249 | B2 * | 7/2013 | Dowling | B65H 29/60 271/225 |
| 9,261,837 | B2 * | 2/2016 | Yamada | G03G 21/1647 |
| 9,540,206 | B2 * | 1/2017 | Masuda | B65H 29/14 |
| 9,790,042 | B2 * | 10/2017 | Iwasawa | B65H 5/36 |
| 10,703,594 | B2 * | 7/2020 | Furusawa | B65H 29/52 |
| 11,027,937 | B2 * | 6/2021 | Fukasawa | B65H 29/60 |
| 11,262,684 | B2 * | 3/2022 | Ikegami | B65H 29/12 |

FOREIGN PATENT DOCUMENTS

| | | | | |
|---|---|---|---|---|
| JP | 2005140193 A | * | 6/2005 | |
| JP | 2009-234720 A | | 10/2009 | |
| JP | 2014202796 A | * | 10/2014 | B41J 13/076 |

* cited by examiner

*Primary Examiner* — Patrick Cicchino
(74) *Attorney, Agent, or Firm* — Baker Botts L.L.P.

(57) ABSTRACT

A sheet conveyer having a conveyer path to convey a sheet therein, a first path and a second path branched from the conveyer path, a flapper, a pair of pivot-shaft portions, and a supporting section, is provided. The flapper is movable between a first position to guide the sheet from the conveyer path to the first path and a second position to guide the sheet from the conveyer path to the second position. The pivot-shaft portions are located apart from each other in a widthwise direction. The pivot-shaft portions support the flapper pivotably. The supporting section is located between the pair of pivot-shaft portions in the widthwise direction. The supporting section supports the flapper pivotably. The supporting section includes a rotation-shaft portion being rotatable, a bearing portion, in which the rotation-shaft portion is fitted, and a buffer member located between the rotation-shaft portion and the bearing portion.

11 Claims, 9 Drawing Sheets

SHEET CONVEYER AND IMAGE FORMING APPARATUS

CROSS REFERENCE TO RELATED APPLICATION

This application claims priority from Japanese Patent Application No. 2019-238561, filed on Dec. 27, 2019, the entire subject matter of which is incorporated herein by reference.

BACKGROUND

Technical Field

An aspect of the present disclosure is related to a sheet conveyer and an image forming apparatus.

Related Art

A sheet conveyer having a flapper is known. The flapper may pivot between a first position, at which the flapper may guide a sheet to a first path, and a second position, at which the flapper may guide a sheet to a second path.

The flapper may have shaft portions, which may be fitted in bearings to be supported pivotably. The shaft portions may be arranged at widthwise end positions and at a central position in a widthwise direction of the flapper, which intersects orthogonally with a sheet-conveying direction.

With the shaft portion arranged at the widthwise central position, the flapper may be restrained from warping in a direction intersecting with the widthwise direction.

SUMMARY

However, when the flapper pivots, the shaft portion arranged at the central position may collide with the bearing at the central position and produce noise.

The present disclosure is advantageous in that a sheet conveyer and an image forming apparatus having a flapper, which may be restrained from warping, and in which collision between a pivot shaft and a bearing may be moderated by a buffer, while the buffer may be restrained from interfering with the pivoting flapper, are provided.

According to an aspect of the present disclosure, a sheet conveyer having a conveyer path, a first path and a second path, a flapper, a pair of pivot-shaft portions, and a supporting section, is provided. The conveyer path is configured to convey a sheet therein. The first path and the second path are branched from the conveyer path. The flapper is movable between a first position, at which the flapper guides the sheet from the conveyer path to the first path, and a second position, at which the flapper guides the sheet from the conveyer path to the second position. The pair of pivot-shaft portions are located apart from each other in a widthwise direction, which intersects orthogonally with a conveying direction. The pivot-shaft portions support the flapper pivotably. The supporting section is located between the pair of pivot-shaft portions in the widthwise direction. The supporting section supports the flapper pivotably. The supporting section includes a rotation-shaft portion being rotatable, a bearing portion, in which the rotation-shaft portion is fitted, and a buffer member located between the rotation-shaft portion and the bearing portion.

According to another aspect of the present disclosure, an image forming apparatus, having a sheet conveyer and an image forming device is provided. The sheet conveyer has a conveyer path, a first path and a second path, a flapper, a pair of pivot-shaft portions, and a supporting section. The conveyer path is configured to convey a sheet therein. The first path and the second path are branched from the conveyer path. The flapper is movable between a first position, at which the flapper guides the sheet from the conveyer path to the first path, and a second position, at which the flapper guides the sheet from the conveyer path to the second position. The pair of pivot-shaft portions are located apart from each other in a widthwise direction, which intersects orthogonally with a conveying direction. The pivot-shaft portions support the flapper pivotably. The supporting section is located between the pair of pivot-shaft portions in the widthwise direction. The supporting section supports the flapper pivotably. The supporting section includes a rotation-shaft portion being rotatable, a bearing portion, in which the rotation-shaft portion is fitted, and a buffer member located between the rotation-shaft portion and the bearing portion. The image forming device is configured to form an image on the sheet. The sheet with the image formed thereon in the image forming device is conveyed in the conveyer path.

BRIEF DESCRIPTION OF THE ACCOMPANYING DRAWINGS

DETAILED DESCRIPTION

An embodiment of the present disclosure will be described with reference to the accompanying drawings in the following paragraphs. It is noted that various connections may be set forth between elements in the following description. These connections in general and, unless specified otherwise, may be direct or indirect and that this specification is not intended to be limiting in this respect. It will be understood that those skilled in the art will appreciate that there are numerous variations and permutations of an image reading apparatus that fall within the spirit and scope of the invention.

[Overall Configuration of Image Forming Apparatus]

Figure 1:
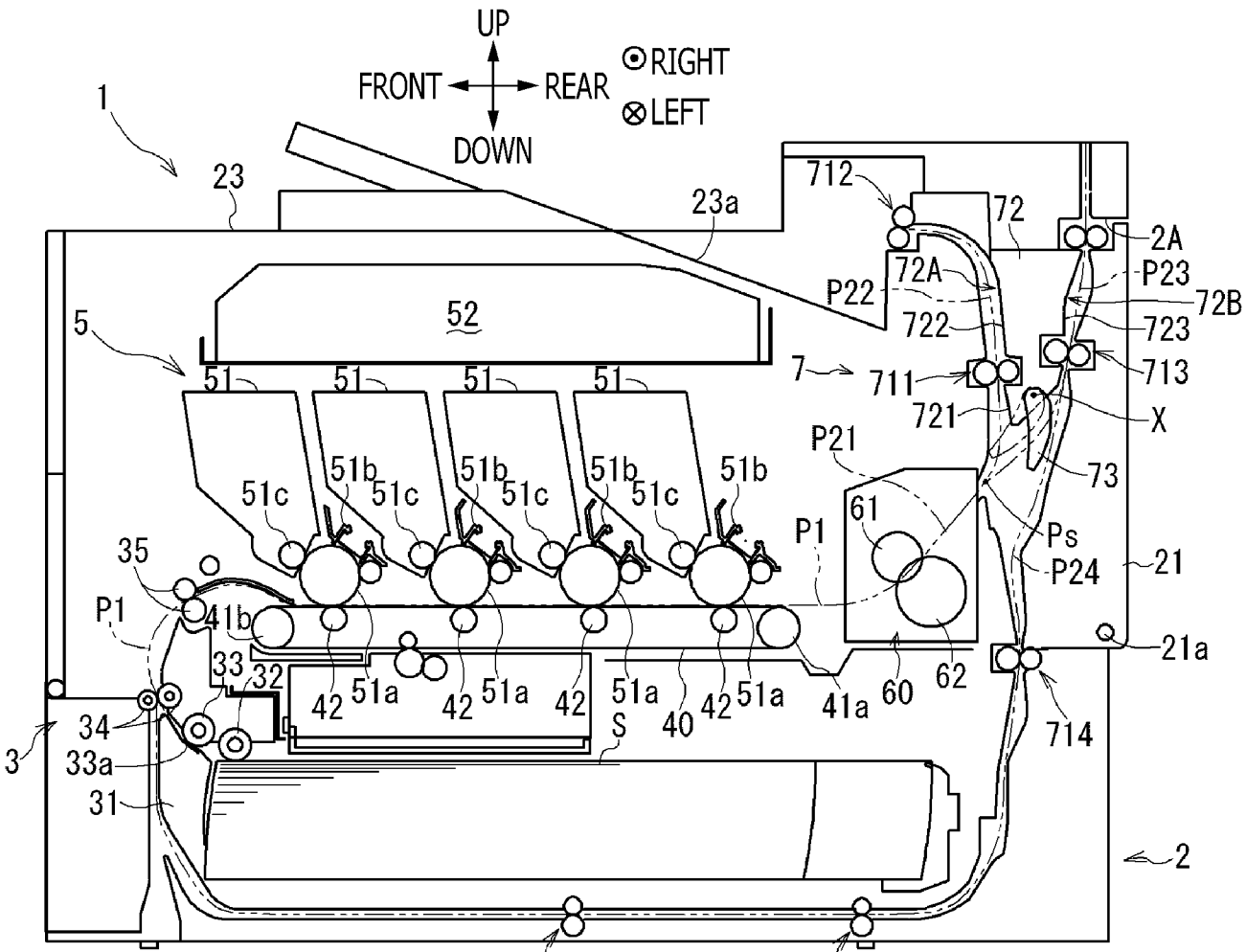
FIG. 1 is a cross-sectional view of an image forming apparatus at a widthwise central position according to an embodiment of the present disclosure.

FIG. 1 shows an image forming apparatus 1 including a sheet conveyer 7 according to the embodiment of the present disclosure. The image forming apparatus 1 may be, for example, a color laser printer capable of forming an image in multiple colors electro-photographically on a sheet S. For another example, the image forming apparatus 1 may be a monochrome laser printer capable of forming an image in a single color on a sheet S. For another example, the sheet conveyer may not necessarily be provided in an image forming apparatus but may be provided in an image reading apparatus capable of reading an image of a sheet being conveyed.

In the following description, positional relation within the image forming apparatus 1 and each part or item included in the image forming apparatus 1 will be mentioned on basis of the orientation of the image forming apparatus 1 as indicated by arrows in FIG. 1. For example, a left-hand side and a right-hand side in FIG. 1 to a viewer may be referred to as a front side and a rear side of the image forming apparatus 1, respectively. A nearer side and a farther side in a direction of depth in FIG. 1 to the viewer may be referred to as a rightward side and a leftward side of the image forming apparatus 1, respectively. A right-to-left or left-to-right direction may be called as a widthwise direction, a front-to-rear or rear-to-front direction may be called as a front-rear direction. An up-to-down or down-to-up direction in FIG. 1 may be defined as a vertical direction. Furthermore, directions of the drawings in FIGS. 2-9 are similarly based on the orientation of the image forming apparatus 1 as defined above and correspond to those with respect to the image reading apparatus 1 shown in FIG. 1 even when the drawings are viewed from different angles.

The image forming apparatus 1 includes a main body 2, a sheet feeder 3, an image forming device 5, and a sheet conveyer 7. The sheet feeder 3 may feed sheets S to the image forming device 5, the image forming device 5 may form images on the sheets S being fed, and the sheet conveyer 7 may convey the sheets with the imaged formed thereon.

The main body 2 may have a shape of an approximately rectangular box and accommodate the sheet feeder 3, the image forming device 5, and the sheet conveyer 7 therein.

The main body 2 has an opening 2A and a rear cover 21, which may open or close the opening 2A, on a rear side thereof. The rear cover 21 is pivotable about a pivot axis 21*a*, which is located on a lower end of the rear cover 21. The rear cover 21 may pivot about the pivot axis 21*a* to move between a closed position, at which the rear cover 21 closes the opening 2A, and an open position, at which the rear cover 21 exposes the opening 2A. An upper side of the main body 2 is covered by an upper cover 23. The upper cover 23 is formed to have an ejection tray 23*a*, which is dented to incline lower-rearward.

The sheet feeder 3 includes a sheet cassette 31, a feed roller 32, a separator roller 33, a separator pad 33*a*, a conveyer roller pair 34, and a registration roller pair 35. Inside the main body 2, a conveyer path P1 for conveying the sheets S therein is formed from the sheet cassette 31 through the image forming device 5.

The sheet cassette 31 may support the sheets S stacked therein. The sheets S supported by the sheet cassette 31 may be fed to the conveyer path P1 one by one separately by the feed roller 32, the separator roller 33, and the separator pad 33*a*. The sheets S fed to the conveyer path P1 may be conveyed by the conveyer roller pair 34 and the registration roller pair 35 toward the image forming device 5.

The image forming device 5 is located at an upper position with respect to the sheet feeder 3 and may include four (4) drum units 51, which align in line along the front-rear direction. The drum units 51 are provided for colors of black, yellow, magenta, and cyan, and each drum unit 51 includes a photosensitive drum 51*a*, a charger 51*b*, and a developing roller 51*c*.

The image forming device 5 further includes a scanner unit 52 and a fuser unit 60. The scanner unit 52 is located at an upper position in the main body 2 and includes light sources, polygon mirrors, lenses, and reflective mirrors. In the scanner unit 52, laser beams emitted from the light sources based on image data may scan surfaces of the photosensitive drum 51*a* so that the surfaces of the photosensitive drums 51*a* may be selectively exposed to the laser beams. The fuser unit 60 is located at a position downstream from a most downstream one of the photosensitive drums 51*a* along a conveying direction for conveying the sheets S.

At a lower position across the conveyer path P1 from the image forming device 5, a transfer belt 40 is arranged. The transfer belt 40 is strained around a driving roller 41*a* and a driven roller 41*b* arranged at a frontward position with respect to the driving roller 41*a*. At positions across the transfer belt 40 from the photosensitive drums 51*a*, transfer rollers 42 are arranged.

In the image forming device 5, the surfaces of the photosensitive drums 51*a* may be charged evenly by the chargers 51*b* and exposed selectively to the laser beams from the scanner unit 52. Thereby, charges may be selectively removed from the surfaces of the photosensitive drums 51*a*, and electrostatic latent images based on the image data may be formed on the photosensitive drums 51*a*.

Meanwhile, developing bias may be applied to the developing rollers 51*a*. When the electrostatic latent images formed on the photosensitive drums 51*c* faces the developing rollers 51*c*, due to the difference in potentials between the electrostatic latent images and the developing rollers 51*c*, toners may be supplied from the developing rollers 51*c* to the electrostatic latent images. Thus, toner images may be formed on the surfaces of the photosensitive drums 51*a*.

The sheet S conveyed to the image forming device 5 and reaching the transfer belt 40 may be conveyed further by the transfer belt 40 and pass through the positions between the transfer belt 40 and the photosensitive drum 51*a* one after another. Meanwhile, the toner images formed on the surfaces of the photosensitive drums 51*a*, when facing the sheet S being conveyed on the transfer belt 40, may be transferred to the sheet S by transferring bias applied to the transfer rollers 42.

The sheet S with the toner images transferred thereon may be conveyed to the fuser unit 60. The fuser unit 60 includes a heat roller 61 to heat the sheet S and a pressure roller 62 arranged to face the heat roller 61. The sheet S conveyed to the fuser unit 60 may pass through a position between the heat roller 61 and the pressure roller 61, which are urged against each other, so that the transferred toner images may be fused and fixed on the sheet S.

The sheet S with the toner images fixed thereon may be conveyed by the sheet conveyer 7 downstream from the image forming device 5 in the conveying direction. The sheet S conveyed by the sheet conveyer 7 may either be ejected to rest on the ejection tray 23*a* or conveyed to return to the image forming device 5 through a second path P23 and a third path P24 forming a duplex path, which will be described further below.

[Sheet Conveyer]

Figure 2:
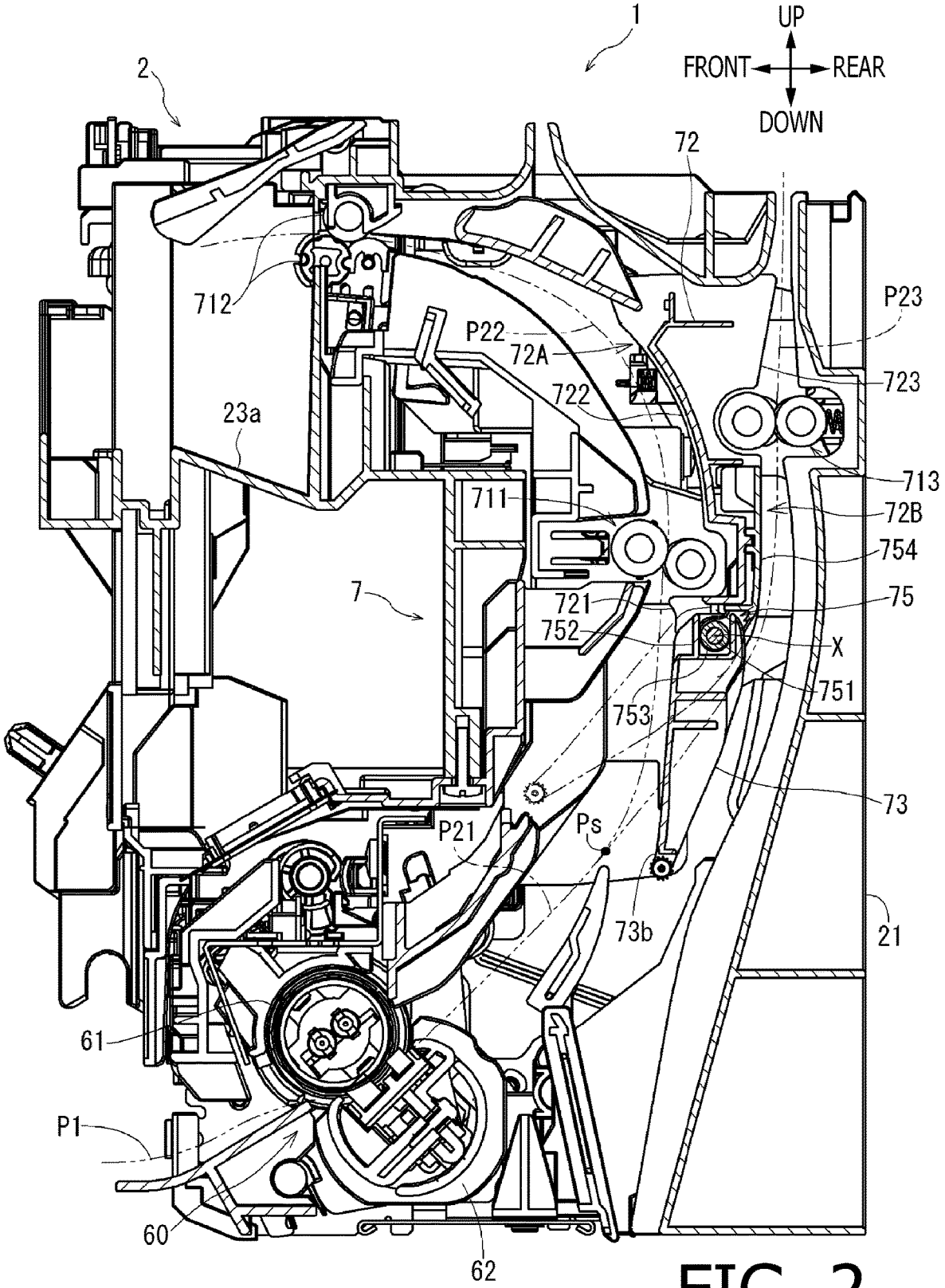
FIG. 2 is a cross-sectional side view of a sheet conveyer according to the embodiment of the present disclosure.

As shown in FIGS. 1-2, the sheet conveyer 7 has a conveyer path P21, a first path P22 and a second path P23, which are branched from the conveyer path P21, and a third path P24, which is branched from the second path P23, for conveying the sheet S.

The conveyer path P21 is a path, in which the sheet S with the images formed thereon in the image forming device 5 may be conveyed downstream in the conveying direction from the image forming device 5. The conveyer path P21 extends upper-rearward from the fuser unit 60.

The first path P22 is branched at a branch position Ps from the conveyer path P21. The first path P22 is a path to guide the sheet S conveyed through the conveyer path P21 to the ejection tray 23*a*. In other words, the first path P22 is a path, in which the sheet S with the images formed thereon in the image forming device 5 may pass through for the sheet S to be ejected at the ejection tray 23*a*. The first path P22 extends upward from the branch position Ps and curves frontward toward the ejection tray 23*a*.

In the first path P22, an intermediate ejection roller pair 711 and an ejection roller pair 712 are arranged. The ejection roller pair 712 is located downstream in the conveying direction from the intermediate ejection roller pair 711. The intermediate ejection roller pair 711 may convey the sheet S conveyed through the conveyer path P21 further in the first path P22. The ejection roller pair 712 may convey the sheet S conveyed in the first path P22 by the intermediate roller pair 711 further to the ejection tray 23*a*.

The second path P23 and the third path P24 form a duplex path to convey the sheet S, which is conveyed downstream from the image forming device 5, to return to the image forming device 5. For example, for duplex printing to form images on both sides of the sheet S, the sheet S conveyed through the image forming device 5 downstream in the conveying direction may be conveyed in the second path P23 and the third path P24 to return to the image forming device 5.

The second path P 23 is branched at the branch position Ps from the conveyer path P21. The second path P23 is a path to switchback the sheet S conveyed through the image forming device 5 and invert a leading end and a trailing end of the sheet S for duplex printing. In other words, the second path P 23 is a path, in which the sheet S with the images formed on one side thereof in the image forming device 5 may be switched back in order for forming images on the other side. The second path P23 extends upper rearward from the branch position Ps.

In the second path P23, a switchback roller pair 713 is arranged. The switchback roller pair 713 is rotatable bidirectionally. In other words, the switchback roller pair 713 may be driven rotate in a normal direction, in which the sheet S may be drawn to the second path P23, and a reverse direction, in which the sheet S may be conveyed from the second path P23 to the third path P24.

The third path P24 is branched from the second path P 23. The third path P24 is a path, in which the inverted sheet S may be conveyed once again toward the image forming device 5. The third path P23 extends downward from a branch position, at which the third path P23 is branched from the second path P23, and curves frontward and thereafter upward to merge with the conveyer path P1. The sheet S may be conveyed in the third path P24 by an intermediate duplex conveyer roller pair 714, a first duplex conveyer roller pair 715, and a second duplex conveyer roller pair 716 toward the image forming device 5.

The sheet conveyer 7 includes a guide member 72. The guide member 72 includes a first guide face 721, a second guide face 722, and a third guide face 723. The first and second guide faces 721, 722 are formed on a frontward side 72A of the guide member 72. The first and second guide faces 721, 722 each form at least a part of the first path P22. The third guide face 723 is formed on a rearward side 72B of the guide member 72. The third guide face 723 forms at least a part of the second path P23. The first guide face 721 is located upstream from the second guide face 722 in the conveying direction. The first guide face 721 and second guide face 722 may be a face virtually spreading on frontward edges of ribs formed on the frontward side 72A of the guide member 72. The third guide face 723 may be a face virtually spreading on rearward edges of ribs formed on the rearward side 72B of the guide member 72.

The first guide face 721 and the second guide face 722 may guide the sheet S being conveyed in the first path P22. The third guide face 723 may guide the sheet S being conveyed in the second path P23.

The sheet conveyer 7 includes a flapper 73. The flapper 73 is located at the branch position Ps. The flapper 73 is supported by the guide member 72 pivotably to pivot about a pivot axis X, which is at an upper end of the flapper 73. The pivot axis X extends in the widthwise direction. The flapper 73 may switch the conveying direction for the sheet S being conveyed through the conveyer path P21 between the first path P22 and the second path P23.

In other words, the flapper 73 may switch positions thereof between a first position, drawn in solid lines in FIGS. 1-2, in which the flapper 73 may guide the sheet S from the conveyer path P21 to the first path P22, and a second position, drawn in broken lines in FIGS. 1-2, in which the flapper 73 may guide the sheet S from the conveyer path P21 to the second path P23.

Figure 3:
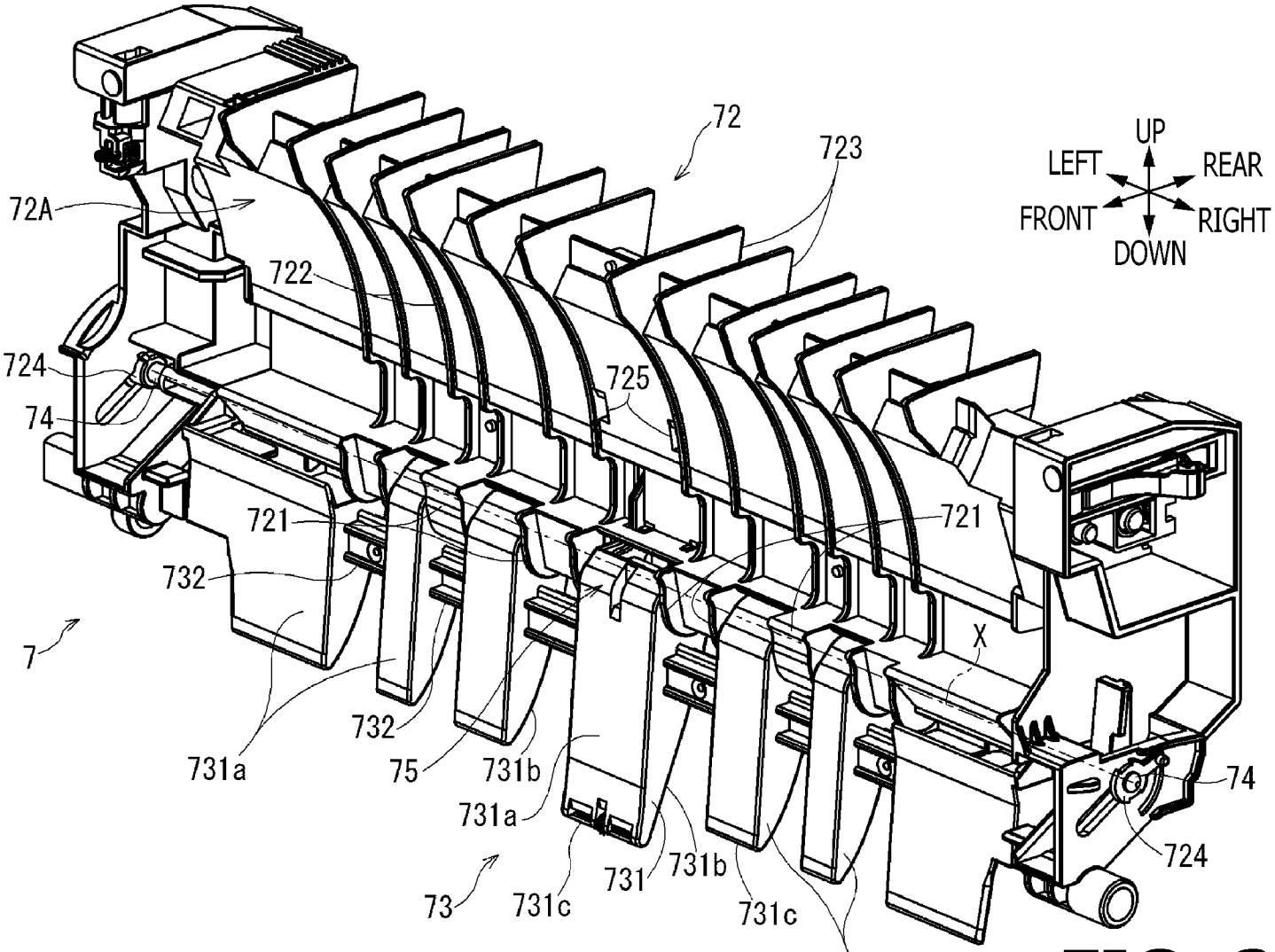
FIG. 3 is a perspective view of the sheet conveyer according to the embodiment of the present disclosure showing a front side of the sheet conveyer.
Figure 4:
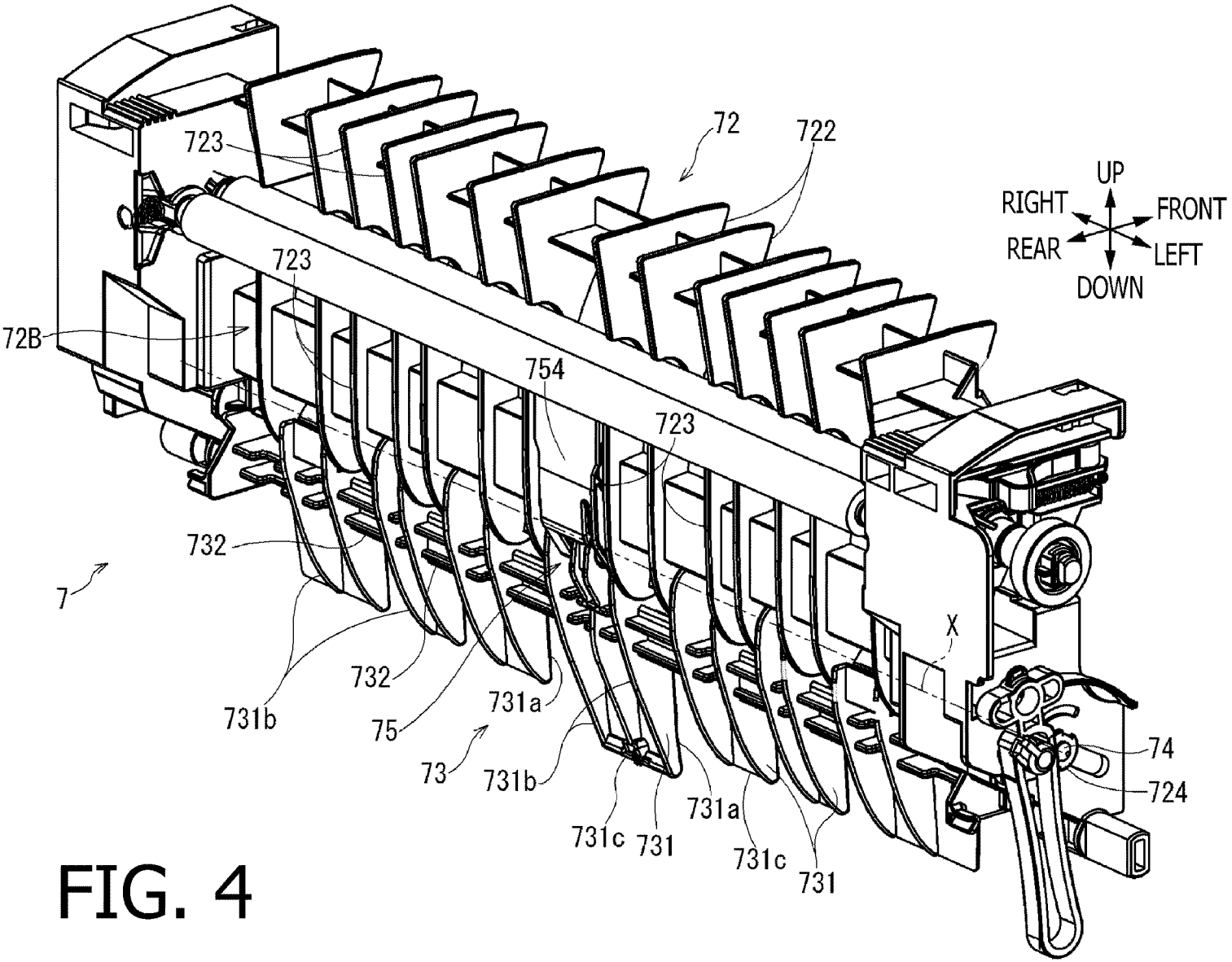
FIG. 4 is a perspective view of the sheet conveyer according to the embodiment of the present disclosure showing a rear side of the sheet conveyer.
Figure 5:
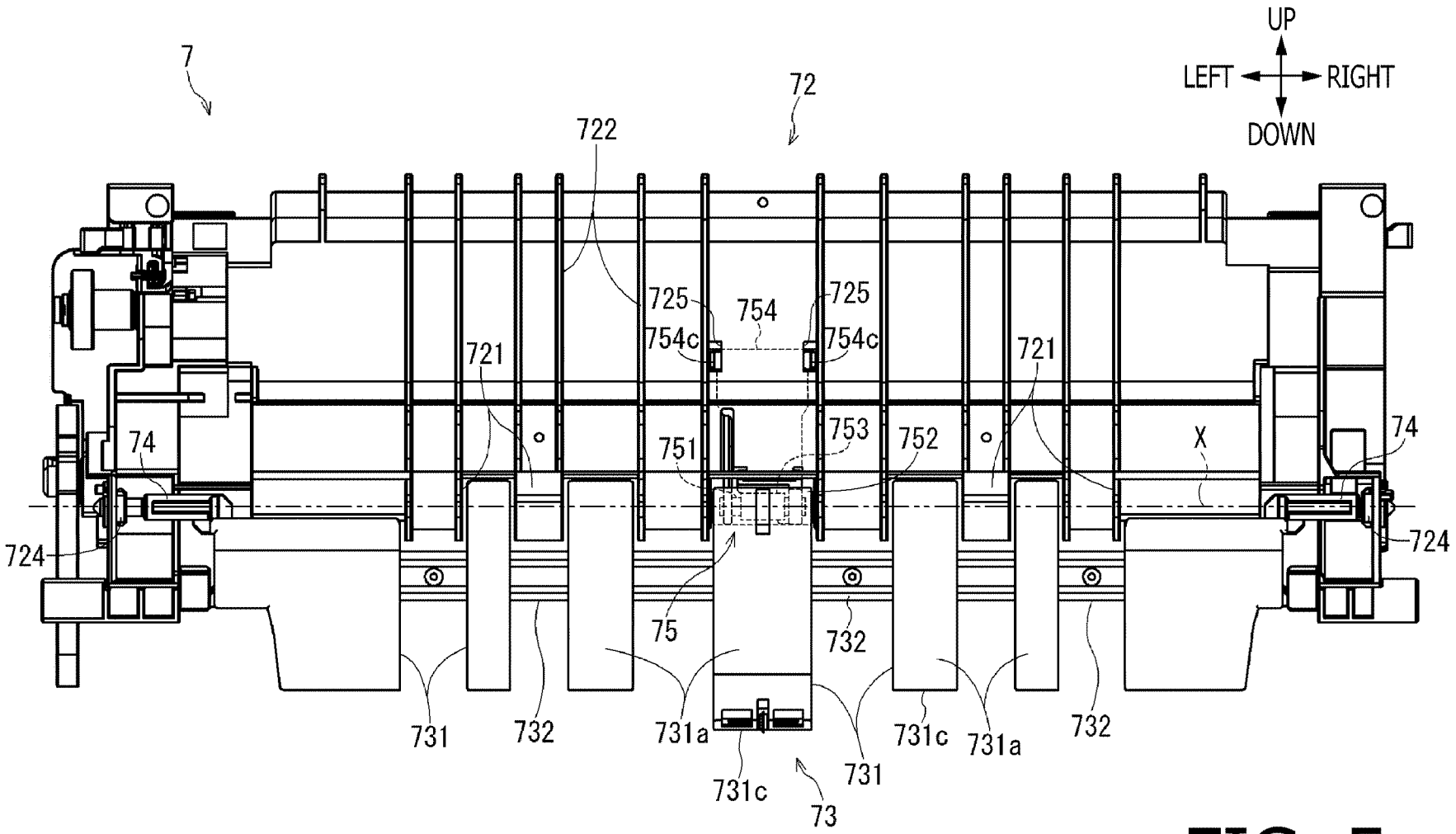
FIG. 5 is a front view of the sheet conveyer according to the embodiment of the present disclosure.

As shown in FIGS. 3-5, the flapper 73 includes a guide part 731 and a connecting part 732. The guide part 731 includes a plurality of guide parts 731, which are spaced apart from one another in the widthwise direction intersecting with the conveying direction. Each guide part 731 includes a guiding surface 731*a* and a guiding surface 731*b*.

The guiding surfaces 731*a* form a frontward face of the guide part 731 and may guide the sheet S to the first path P22 when the flapper 73 is at the first position. The guiding surfaces 731*b* form a rearward face of the guide part 731 and may guide the sheet S to the second path P23 when the flapper 73 is at the second position. Thus, the guide part 731 may guide the sheet S when a route for the sheet S to be conveyed is switched to either the first path P22 or the second path P23.

The guide part 731 extends from the pivot axis X in a direction intersecting with the widthwise direction. An end of the guide part 731 located opposite to the pivot axis X in the extending direction forms a tip end 731*c*.

The connecting part 732 connects adjoining ones of the guide parts 731 adjoining along the widthwise direction. The connecting part 732 is located closer to the tip ends 731*c* of the guide parts 731 than the pivot axis X.

The sheet conveyer 7 includes a pair of pivot-shaft portions 74, which are located apart from each other in the widthwise direction, to support the flapper 73 pivotably. The pivot-shaft portions 74 are formed integrally with the flapper 73 at widthwise ends of the flapper 73 and protrude outward in the widthwise direction from the widthwise end portions of the flapper 73. The guide member 72 includes bearings 724, which support the pivot-shaft portions 74 pivotably. The bearings are located at widthwise ends of the guide member 72.

Optionally, the pivot-shaft portions 74 may be formed separately from the flapper 73 and attached to the flapper 73.

An axis of the pivot-shaft portions 74 coincides with the pivot axis X. Therefore, with the pivot-shaft portions 74 being supported by the bearing 724, the flapper 73 is supported by the guide member 72 pivotably about the pivot axis X.

While the flapper 73 is supported by the guide member 72, the first guide face 721 of the guide member 72 is located between the adjoining ones of the guide parts 731 in the widthwise direction. In this arrangement, the first guide face 721 and the guiding surfaces 731*a* of the guide member 731 overlap each other at least partially in the conveying direction.

Therefore, when the flapper 73 guides the sheet S from the conveyer path P21 to the first path P22, the sheet S may be passed from the guiding surfaces 731*a* of the guide member 731 to the first guide face 721 of the guide member 72 smoothly.

While the flapper 73 is supported by the guide member 72, moreover, a lower end of the third guide face 723 of the guide member 72 is located between the adjoining ones of the guide parts 731 in the widthwise direction. The third guide face 723 and the guiding surfaces 731*b* of the guide member 731 are arranged to overlap each other at least partially in the conveying direction.

Therefore, when the flapper 73 guides the sheet S from the conveyer path P21 to the second path P23, the sheet S may be passed from the guiding surfaces 731*b* of the guide member 731 to the third guide face 723 of the guide member 72 smoothly.

The sheet conveyer 7 is located between the paired pivot-shaft portions 74 in the widthwise direction and includes a supporting section 75, which may support the flapper 73 pivotably. For example, the supporting section 75 may support one of the guide parts 731 located at center in the widthwise direction. In other words, the supporting section 75 may support a part of the flapper 73 between the paired pivot-shaft portions 74 in the widthwise direction.

However, the supporting section 75 may not necessarily support the part of the flapper 73 at the central position between the paired pivot-shaft portions 74 in the widthwise direction as long as the supporting section 75 supports the part of the flapper 75 at any position between the paired pivot-shaft portions 74 in the widthwise direction. For another example, the supporting section 75 may support the flapper 73 at a plurality of positions between the paired pivot-shaft portions 74 in the widthwise direction.

Figure 6:
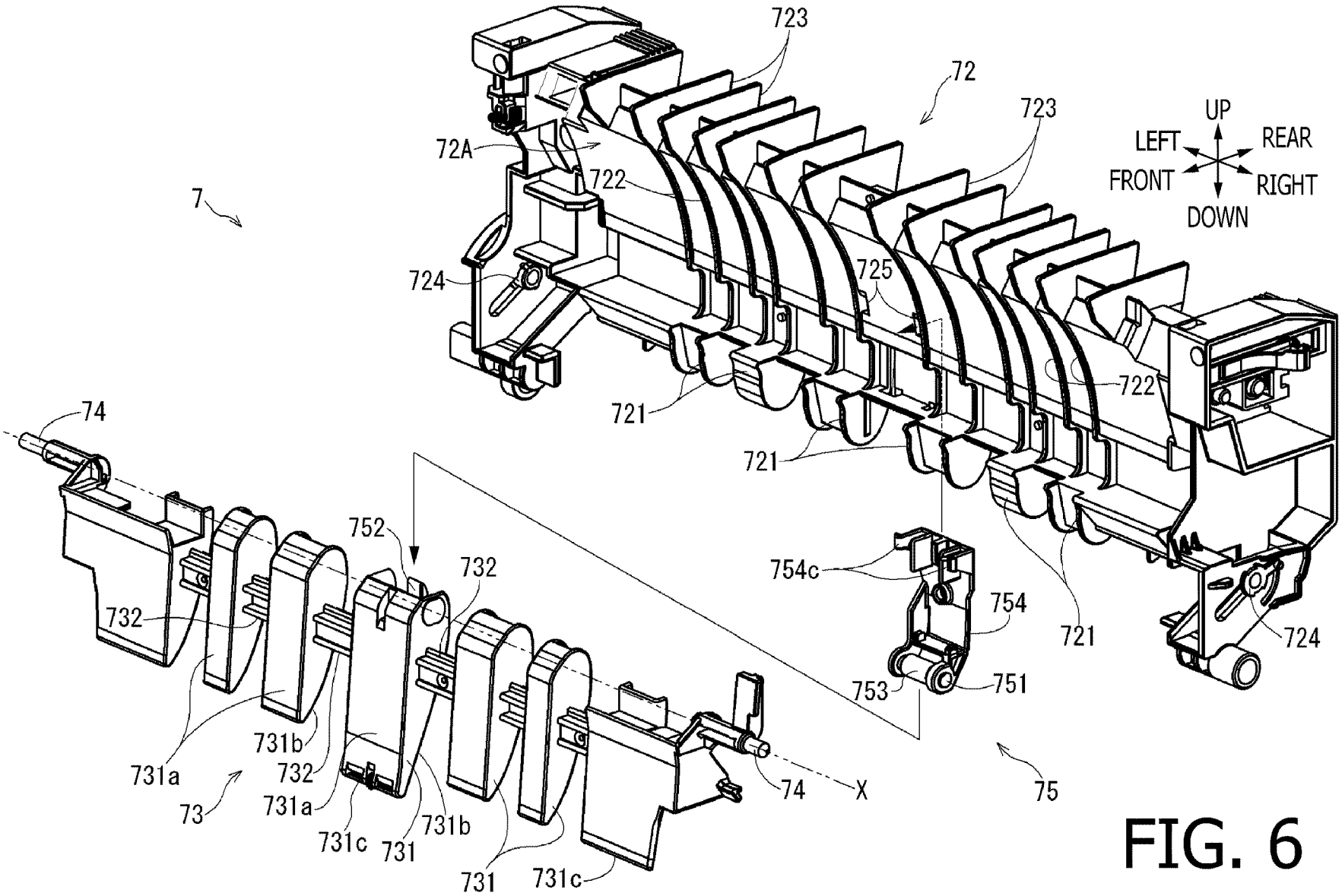
FIG. 6 is an exploded view of the sheet conveyer according to the embodiment of the present disclosure.
Figure 7:
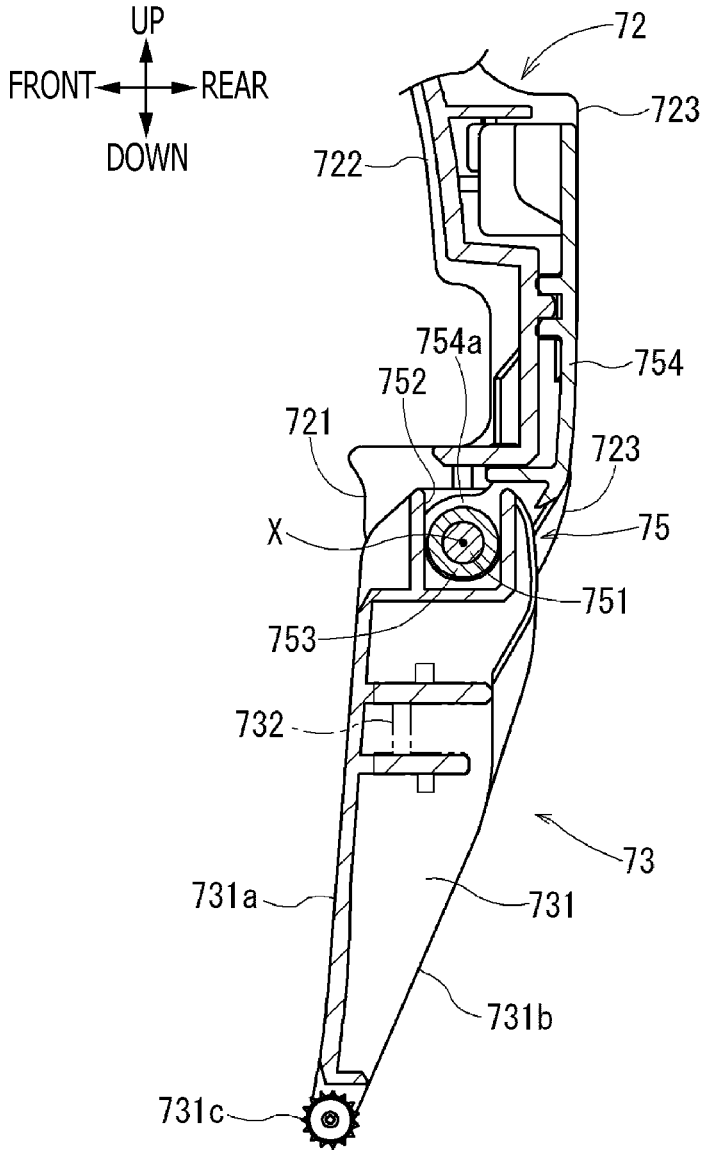
FIG. 7 is a cross-sectional side view of a supporting section in the sheet conveyer according to the embodiment of the present disclosure.
Figure 8:
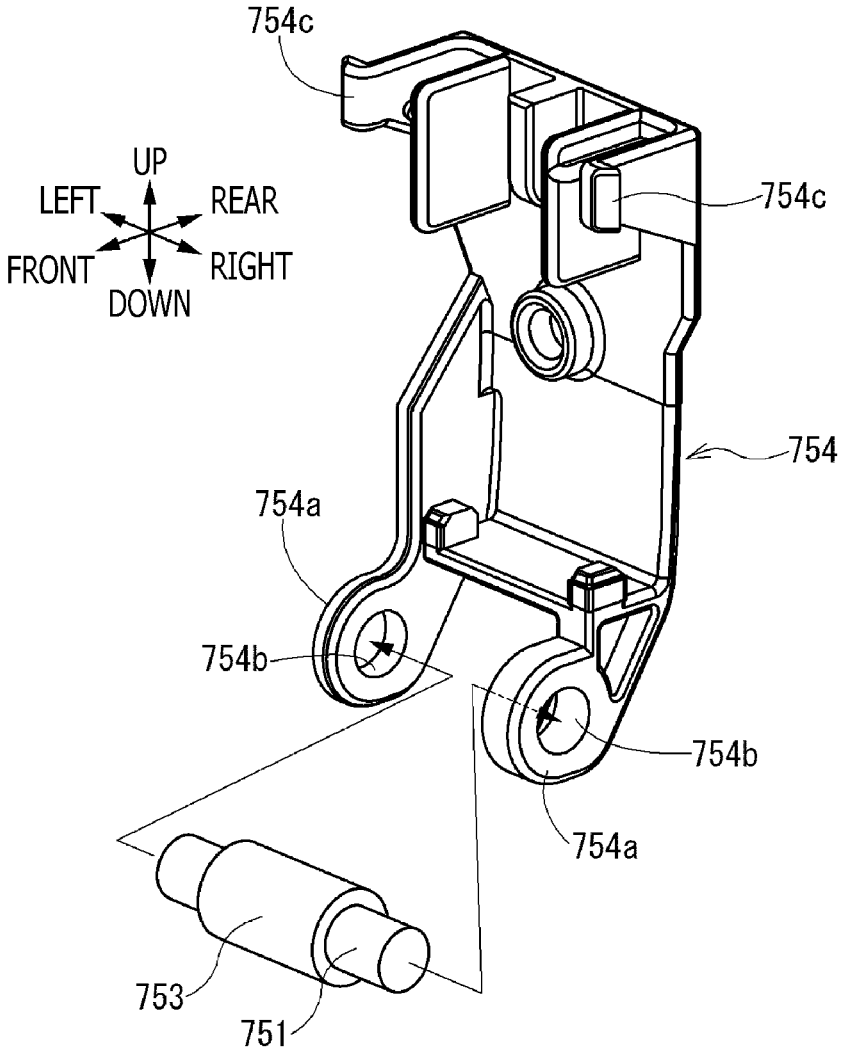
FIG. 8 is a perspective view of a pivot shaft, a buffer member, and a holder for the sheet conveyer according to the embodiment of the present disclosure.

As shown in FIGS. 6-8, the supporting section 75 includes a rotation-shaft portion 751 which is rotatable, a bearing portion 752, in which the rotation-shaft portion 751 rotatably fits, a buffer member 753 arranged between the rotation-shaft portion 751 and the bearing portion 752, and a holder 754 to hold the rotation-shaft portion 751 rotatably.

The rotation-shaft portion 751 is a shaft member, of which axis extends along the widthwise direction, and is held rotatably in the holder 754. The holder 754 includes a retainer portion 754*a* to retain the rotation-shaft portion 751 rotatably. The retainer portion 754*a* is formed to have retainer holes 754*b*, in which axial ends of the rotation-shaft portion 751 are rotatably inserted to be retained by the retainer portion 754*a*.

The holder 754 includes engagement claws 754*c* engageable with attachment holes 725 formed in the guide member 72. With the engagement claws 754*c* being engaged with the attachment holes 725 from a rear side, the holder 754 may be attached to the guide member 72. In this arrangement, the rotation-shaft portion 751 is rotatably retained by the guide member 72 through the holder 754.

The bearing portion 752 is formed at an upper end position in the guide part 731 integrally with the guide part 731 in the flapper 73. The bearing portion 752 is in a form of a groove, which is open upward. In the bearing portion 752, the rotation-shaft portion 751 is fitted rotatably. With the rotation-shaft portion 751 rotatably fitting in the bearing portion 752, the flapper 73 may be pivotably supported by the guide member 72 at the part located between the paired rotation shafts 74 in the widthwise direction. An axis of the rotation-shaft portion 751 fitting in the bearing portion 752 coincides with the pivot axis X. In other words, the axis of the pivot-shaft portions 74 and the axis of the pivot shaft 751 both coincide with the pivot axis X. In this regard, a part of the flapper 73 may form the supporting section 75.

Optionally, however, the bearing portion 752 may be formed separately from the flapper 73 and attached to the flapper 73.

On an outer circumferential surface of the rotation-shaft portion 751, the buffer member 753 is wrapped around. The buffer member 753 is located between the rotation-shaft portion 751 and the bearing portion 752 when the rotation-shaft portion 751 is placed to fit in the bearing portion 752. The buffer member 753 may absorb impact, which may be produced when the rotation-shaft portion 751 in the bearing portion 752 collides with the bearing portion 752, and reduce noise from the collision. The buffer member 753 may be made of, for example, rubber, sponge, or other elastic material such as resin.

The buffer member 753 is attached to the rotation-shaft portion immovably or not rotatably. When an outer circumferential surface of the buffer member 753 contacts an inner surface of the bearing portion 752, due to a friction force produced between the buffer member 753 and the bearing portion 752, the buffer member 753 and the bearing portion 752 may have difficulty in rotating relatively to each other. In this regard, however, the rotation-shaft portion 751, to which the buffer member 753 is attached, is rotatably supported by the guide member 72. Therefore, the flapper 73 may overcome the friction force and pivot with respect to the guide member 72.

Thus, in the sheet conveyer 7, with the supporting section 75 that supports the intermediate part between the paired pivot-shaft portions 74 in the widthwise direction, the part of the flapper 73 supported at the supporting section 75 may be restrained from moving in the direction intersecting with the widthwise direction, and the flapper 73 may be restrained from warping. In particular, in the present embodiment, the supporting section 75 supports the part of the flapper 73 at the center in the widthwise direction; therefore, the flapper 73 may be restrained from warping more effectively.

Moreover, with the buffer member 753 located between the rotation-shaft portion 751 and the bearing portion 752 in the supporting section 75, noise that may be produced by the collision between the rotation-shaft portion 751 and the bearing portion 752 may be reduced. Further, with the rotation-shaft portion 751 enabled to rotate with respect to the guide member 72, the flapper 73 may pivot about the pivot axis X, even when the buffer member 753 which may produce a friction force may be used, and while the influence from the friction force may be restrained from interfering with the pivoting motion of the flapper 73.

In particular, when the conveying route for the sheet S exiting the image forming device 5 is switched between the first path P22 and the second path P23, the noise from the collision between the rotation-shaft portion 751 and the bearing portion 752 may be restrained, and the pivoting motion of the flapper 73 may be restrained from being interfered by the friction force.

Moreover, while the pivoting motion of the flapper 73 may be restrained from being interfered by the friction force when the route to convey the sheet S exiting the image forming device 5 is switched between the first path P22 and the second path P23, the action to eject the sheet S and the action to switchback the sheet S may be switched from one to the other smoothly.

Moreover, in the sheet conveyer 7, the paired pivot-shaft portions 74 to support the flapper 73 pivotably and the bearing portion 752 in the supporting section 73 are formed integrally with the flapper 73. Therefore, the flapper 73 may be restrained from warping reliably.

Moreover, in the sheet conveyer 7, the paired pivot-shaft portions 74 and the rotation-shaft portion 751 in the supporting section 75 are both supported by the guide member 72. Therefore, the flapper 73 may be restrained from warping more reliably. Meanwhile, the rotation-shaft portion 751 may not necessarily be supported by the guide member 72 through the holder 754. Optionally, for example, the guide member 72 may have holes to hold the rotation-shaft portion 751 rotatably so that the rotation-shaft portion 751 may be supported by the guide member 72 without the intervening holder 754.

Although an example of carrying out the invention has been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

First Modified Example

Figure 9:
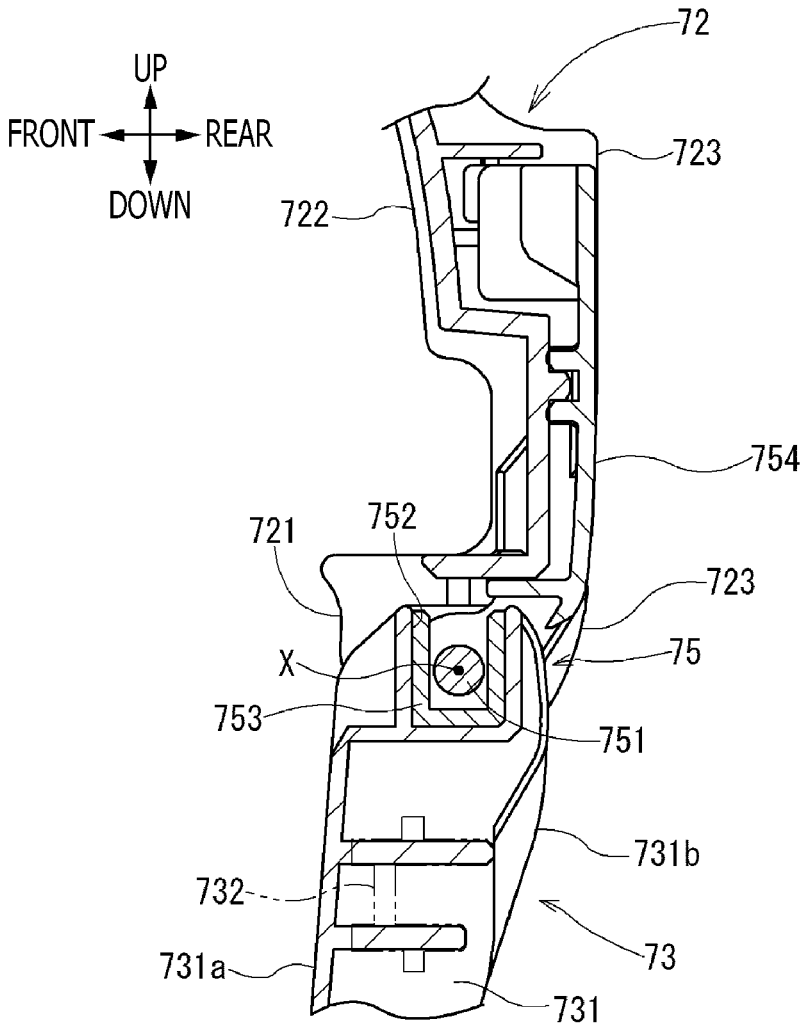
FIG. 9 is a cross-sectional side view of a modified example of the supporting section in the sheet conveyer according to the embodiment of the present disclosure.

For example, the buffer member 753 may not necessarily be arranged on the outer circumferential surface of the rotation-shaft portion 751 but may be arranged on the inner surface of the bearing portion 752, as shown in FIG. 9. In this arrangement, the buffer member 753 is still arranged between the rotation-shaft portion 751 and the bearing portion 752.

Second Modified Example

For another example, in the supporting section 75, the bearing portion 752 may be arranged in the guide member 72, and the rotation-shaft portion 751 may be rotatably supported by the flapper 73. In this arrangement, the rotation-shaft portion 751 may be supported by the flapper 73 through the holder 754. For another example, the flapper 73 may be formed to have a hole, in which the rotation-shaft portion 751 may fit rotatably. In this arrangement, the rotation-shaft portion 751 may be supported by the flapper 73 without the holder 754 to intervene between the rotation-shaft portion 751 and the flapper 73.

In this arrangement, in which the rotation-shaft portion 751 is rotatably supported by the flapper 73, the buffer member 753 may be arranged on the outer circumferential surface of the rotation-shaft portion 751, and when the rotation-shaft portion 751 fits in the bearing portion 752 in the guide member 72, the buffer member 753 may still be arranged between the rotation-shaft portion 751 and the bearing portion 752. Meanwhile, in the arrangement, in which the buffer member 753 is arranged on the inner surface of the bearing portion 752, when the rotation-shaft portion 751 is fitted in the bearing portion 752, the buffer member 753 may still be arranged between the rotation-shaft portion 751 and the bearing portion 752.

What is claimed is:

1. A sheet conveyer, comprising:

a conveyer path configured to convey a sheet therein;

a first path and a second path branched from the conveyer path;

a flapper movable between a first position, at which the flapper guides the sheet from the conveyer path to the first path, and a second position, at which the flapper guides the sheet from the conveyer path to the second position;

a pair of pivot-shaft portions located apart from each other in a widthwise direction, the widthwise direction intersecting orthogonally with a conveying direction, the pivot-shaft portions supporting the flapper pivotably;

a rotation-shaft portion extending in the widthwise direction, the rotation-shaft portion being located between the pair of pivot-shaft portions in the widthwise direction;

a bearing portion, in which the rotation-shaft portion is rotatably fitted; and an elastic buffer member located between the rotation-shaft portion and the bearing portion, wherein one of the rotation-shaft portion and the bearing portion is arranged in the flapper, and wherein the rotation-shaft portion, the bearing portion, and the elastic buffer member form a supporting section supporting the flapper pivotably.

2. The sheet conveyer according to claim 1, wherein the supporting section supports the flapper at a central area in the widthwise direction.

3. The sheet conveyer according to claim 1, wherein the pair of pivot-shaft portions are formed integrally with the flapper, and wherein the bearing portion is formed integrally with the flapper.

4. The sheet conveyer according to claim 3, further comprising:

a guide member including:

bearings configured to support the pair of pivot-shaft portions; and a guide face configured to guide the sheet, wherein the supporting section further includes a holder configured to hold the rotation-shaft portion rotatably, and wherein the holder is attached to the guide member.

5. The sheet conveyer according to claim 4, wherein the flapper includes:

a plurality of guide parts arranged to be spaced apart from one another in the widthwise direction, the guide parts being configured to guide the sheet; and a connecting part connecting the guide parts, wherein the connecting part is located closer to tip ends of the guide parts than a pivot axis of the flapper, and wherein the guide face is located between the guide parts in the widthwise direction.

6. An image forming apparatus, comprising:

a sheet conveyer comprising:

a conveyer path configured to convey a sheet therein;

a first path and a second path branched from the conveyer path;

a flapper movable between a first position, at which the flapper guides the sheet from the conveyer path to the first path, and a second position, at which the flapper guides the sheet from the conveyer path to the second position;

a pair of pivot-shaft portions located apart from each other in a widthwise direction, the widthwise direction intersecting orthogonally with a conveying direction, the pivot-shaft portions supporting the flapper pivotably;

a rotation-shaft portion extending in the widthwise direction, the rotation-shaft portion being located between the pair of pivot-shaft portions in the widthwise direction;

a bearing portion, in which the rotation-shaft portion is rotatably fitted; and an elastic buffer member located between the rotation-shaft portion and the bearing portion, and an image forming device configured to form an image on the sheet, wherein one of the rotation-shaft portion and the bearing portion is arranged in the flapper, wherein the rotation-shaft portion, the bearing portion, and the elastic buffer member form a supporting section supporting the flapper pivotably, and wherein the sheet with the image formed thereon in the image forming device is conveyed in the conveyer path.

7. The image forming apparatus according to claim 6, wherein the first path is a path, in which the sheet with the image formed thereon in the image forming device is conveyed to be ejected outside the image forming apparatus, and wherein the second path is a path, through which the sheet with the image formed on one side thereof is switched back to be conveyed to the image forming device for another image to be formed on the other side thereof.

8. The sheet conveyer according to claim 4, wherein the other of the rotation-shaft portion and the bearing portion is arranged in the holder.

9. The image forming apparatus according to claim 6, wherein the pair of pivot-shaft portions are formed integrally with the flapper, and wherein the bearing portion is formed integrally with the flapper.

10. The image forming apparatus according to claim 9, further comprising:

a guide member including:

bearings configured to support the pair of pivot-shaft portions; and a guide face configured to guide the sheet, wherein the supporting section further includes a holder configured to hold the rotation-shaft portion rotatably, and wherein the holder is attached to the guide member.

11. The sheet conveyer according to claim 10, wherein the other of the rotation-shaft portion and the bearing portion is arranged in the holder.

* * * * *